US006659740B2

(12) United States Patent
Drevet

(10) Patent No.: US 6,659,740 B2
(45) Date of Patent: Dec. 9, 2003

(54) VIBRATING MEMBRANE FLUID CIRCULATOR

(76) Inventor: Jean-Baptiste Drevet, 45, Boulevard Saint-Michel, Paris 75005 (FR)

( * ) Notice: Subject to any disclaimer, the term of this patent is extended or adjusted under 35 U.S.C. 154(b) by 24 days.

(21) Appl. No.: 10/092,735

(22) Filed: Mar. 8, 2002

(65) Prior Publication Data

US 2002/0146333 A1 Oct. 10, 2002

Related U.S. Application Data

(63) Continuation-in-part of application No. 09/745,405, filed on Dec. 26, 2000, now Pat. No. 6,361,284, which is a continuation of application No. 09/117,982, filed on Aug. 11, 1998, now abandoned.

(51) Int. Cl.[7] ..... F04B 19/00
(52) U.S. Cl. ..... 417/436; 417/410.2
(58) Field of Search ..... 417/410.1, 410.2, 417/413.1, 413.2, 436

(56) References Cited

U.S. PATENT DOCUMENTS

| | | | | |
|---|---|---|---|---|
| 3,107,630 A | | 10/1963 | Johnson et al. | |
| 3,620,651 A | * | 11/1971 | Hufton | 417/436 |
| 3,743,446 A | | 7/1973 | Mandroian | |
| 3,765,175 A | | 10/1973 | Ohnaka | |
| 4,063,826 A | | 12/1977 | Riepe | |
| 4,384,830 A | * | 5/1983 | Wakelin | 417/436 |
| 4,488,854 A | | 12/1984 | Miller | |
| 4,498,851 A | | 2/1985 | Kolm et al. | |
| 4,648,807 A | * | 3/1987 | Tippetts et al. | 417/413.2 |
| 4,939,405 A | | 7/1990 | Okuyama et al. | |
| 5,525,041 A | | 6/1996 | Deak | |

FOREIGN PATENT DOCUMENTS

| | | |
|---|---|---|
| DE | 3621766 A1 | 1/1988 |
| EP | 0 412 856 A | 12/1991 |
| SU | 244126 | 10/1969 |

OTHER PUBLICATIONS

Patent Abstracts of Japan, vol. 015, No. 164 (M–1106) Apr. 24, 1991; and JP 0331590 A.
Patent Abstracts of Japan, vol. 009, No. 132 (M–385) 706.85 and JP 60013994 A (Kaetsu Hoshi) Jan. 24, 1985.
Patent Abstracts of Japan, vol. 014, No. 496 (E–0996) Oct. 29, 1990 and JP 02206339 A (Aisin Seiki Co., Ltd.) Aug. 16, 1990.
Patent Abstracts of Japan, vol. 015, No. 253 (M–1129) Jun. 27, 1991 and JP03081585 A (Mitsubishi Kasei Corp) Apr. 5, 1991.

* cited by examiner

*Primary Examiner*—Michael Koczo
(74) *Attorney, Agent, or Firm*—Nixon Peabody LLP; Stuart J. Friedman

(57) ABSTRACT

A fluid circulator made up of an admission orifice, a pump body and a delivery orifice, the pump body having two rigid walls defining therebetween a circulation space for fluid circulation from the admission to the delivery orifice. A deformable membrane is maintained under tension in the circulation space parallel to the circulation direction and has one edge located near the admission orifice for coupling to a motor generating a periodic excitation force, the circulation space having a cross section perpendicular to the circulation direction which has a size measured along the periodic force direction progressively decreasing from the admission to the delivery orifice.

6 Claims, 3 Drawing Sheets

VIBRATING MEMBRANE FLUID CIRCULATOR

This is a continuation in part of application Ser. No. 09/745,405 filed on Dec. 26, 2000 which is a continuation application of application Ser. No. 09/117,982 filed Aug. 11, 1998, now abandoned.

The present invention relates to a vibrating membrane fluid circulator.

Numerous types of pump are known both in industrial and in biomedical fields. The following can be mentioned:

- reciprocating positive displacement pumps whose main elements are pistons or membranes associated with admission and delivery valves. Their main drawback lies in the cyclical aspect of their motion and in the presence of the valves;
- so-called "peristaltic" positive displacement pumps in which continuously moving wheels deform and compress a flexible tubular pump body. The compression can be damaging for certain liquids to be pumped that include sensitive elements (e.g. blood);
- "impeller" pumps such as centrifugal pumps based on a vaned rotor or a vortex. Their drawback lies in the high speed of rotation which generates shear in the fluid streams, friction, and cavitation, all of which phenomena can be damaging to fragile fluids; and
- axial turbine pumps in which fragile fluids suffer likewise from the same drawbacks as in the preceding pumps.

Also known is a vibrating-membrane fluid propulsion device, as described in document FR-A-2 650 862. That device provides a technical solution which is not always suitable for obtaining the hydraulic performance required by most industrial and biomedical applications, The vibrating membrane fluid circulator of the invention proposes solutions whereby the fields of application of the circulator are enlarged, the hydraulic performance thereof is improved, the circulator is more compact, and finally the pump body can he for a single use only, which is advantageous in the biomedical field.

To this end, the fluid circulator of the invention comprises an internal hydraulic circuit made up in succession of an admission orifice, a pump body and a delivery orifice, the pump body having two rigid walls defining therebetween a pumping chamber for the fluid extending from said admission orifice to said delivery orifice with a deformable membrane located in said pumping chamber and having two external surfaces facing respectively said walls, at least one of said membrane surfaces and at least one said walls defining in said pumping chamber a circulation space for the fluid, said deformable membrane being maintained under a tension parallel to the fluid circulation direction from said admission orifice to said delivery orifice, said membrane having one edge located near said admission orifice and provided with means for coupling to a motor member generating a periodic excitation force substantially normal to the external faces of said membrane, said circulation space having a cross section perpendicular to the fluid circulation direction the size of which measured in the periodic force direction being progressively decreasing from said admission orifice to said delivery orifice.

Means to keep the membrane under tension enable it to constitute a medium for waves travelling from the edge of the membrane subjected to the excitation force towards its opposite edge. Displacement of these waves is accompanied by forced damping due to the shape of the rigid walls, which results in a reduction of the width (thickness) of the cross section of the circulation space along the circulation direction, so that mechanical energy is transferred from the membrane to the fluid, with this appearing in the form of a pressure gradient and of a fluid flow. The characteristics of the pressure gradient and of the fluid flow are related to the dimensions of the pump body, to the dimensions of the membrane, to the shape and the spacing of the rigid walls, to the mechanical characteristics and the tension state of the membrane, and to the parameters of the excitation applied thereto.

The periodic excitation of the membrane is implemented at frequencies which are associated with the mechanical characteristics of the membrane and with its tension state. The excitation frequency should be kept down to low values of the order of 40 Hz to 80 Hz so as to avoid localized pressure effects and shear effects between fluid streams.

In one embodiment of the invention, said pumping chamber is a flat tubular chamber and the membrane is a flat membrane tapered towards the edge thereof located near said delivery orifice.

In another embodiment of the invention, said pumping chamber is an annular tubular chamber and the membrane is shaped as a sleeve with a larger thickness at its edge near said admission orifice than at its edge near said delivery orifice.

Other characteristics and advantages appear from the description given below of various embodiments of the invention.

Reference is made to the accompanying drawings, in which.

Figure 1:
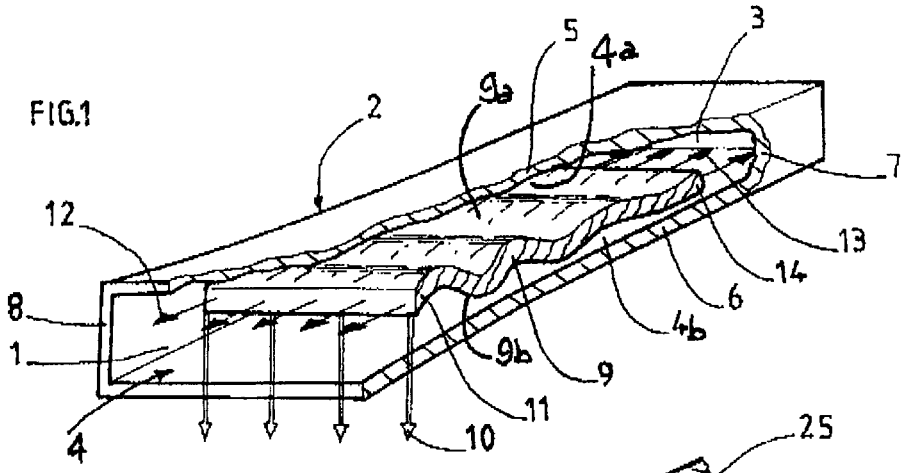
FIG. 1 is a longitudinal section view through a tubular pump body for a longitudinal type fluid circulator, said view being fragmentary and diagrammatic.

The device of the invention shown in FIG. 1 comprises a hydraulic circuit made up in succession of an admission orifice 1, a pump body 2, and a delivery orifice 3. The pump body 2 is a flat tube of varying section which defines a pumping chamber 4 by rigid walls 5, 6, 7, and 8. In the chamber 4 there is housed a deformable propulsion membrane 9 which is in the form of a flexible elastomer strip of width equal to the distance between the walls 7 and 8. Motor means (not shown) generates a periodic excitation force 10 which is applied to coupling means at the edge 11 of said membrane 9 adjacent to the admission orifice 1, said force being regularly distributed over the edge of the membrane and having a direction that is normal to the external faces 9*a* and 9*b* of the membrane 9. The membrane 9 is maintained under tension by members (not shown) developing forces 12 and 13 in opposite directions and applied to the membrane at the edge 11 and at the edge 14 which is near the delivery orifice 3. The membrane 9 defines in the pumping chamber 4 either one or two circulation spaces 4*a* and 4*b* for the fluid. These spaces may be either tightly separated (if the membrane is laterally joined with flexible diaphragm with walls 7 and 8) or in communication along these lateral walls and through apertures made in the membrane at its edge near the admission orifice. When excited, the membrane is thus a medium for waves travelling from the edge 11 which is subjected to the excitation towards the other edge 14 which is situated adjacent the delivery orifice. Wave displacement is accompanied by forced damping due to the shape and to the spacing of the rigid walls 5 and 6, resulting in a progressive decreasing of the thickness of the circulation spaces 4*a* and 4*b* from the admission orifice towards the delivery orifice.

The damping causes energy to be transferred from the membrane 9 to the fluid, with this being in the form of a pressure gradient and a flow of fluid.

Overall the circulator constitutes an energy transducer, successively transferring energy from the excitation motor to the membrane and then from the membrane to the fluid. The energy delivered by the exciter depends on various parameters such as the excitation force, the excitation frequency, and the amplitude of excitation which is itself associated with the excitation frequency and the force. It is thus possible to modulate the energy delivered by the exciter by acting on the various parameters that have an effect on the energy delivered to the membrane.

The mechanical energy in the membrane 9 must essentially behave as a flow of mechanical energy propagating by means of the membrane from the excitation edge 11 where energy is transferred from the exciter to the membrane, towards the other edge of the membrane. This energy comprises a kinetic energy fraction and a deformation energy fraction, and there are physical limits on such operation. The transfer of energy from the membrane to the fluid takes place progressively along the length of the membrane with the waves simultaneously propagating and being damped.

The hydraulic energy of the fluid is expressed as the hydraulic power delivered by the circulator, i.e. the product of the flow rate multiplied by the pressure gradient, with the relationship between flow rate and pressure depending mainly on the dimensions of the pump body and of the membrane, and on the spacing and the shape of the rigid walls 5 and 6, this also taking into account the internal headlosses of the system.

Figure 2:
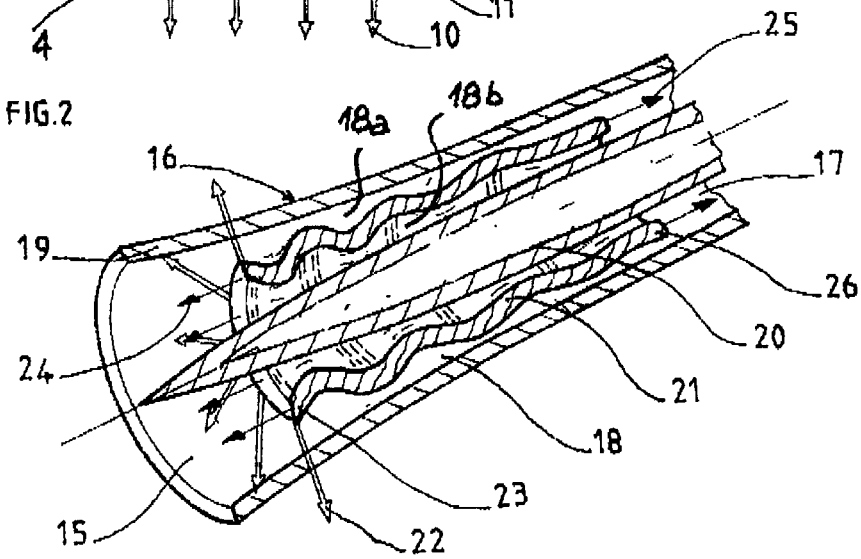
FIG. 2 is a longitudinal section view through a pump body of a cylindrical type fluid circulator.

A variant of the device is shown in FIG. 2, where the hydraulic circuit is cylindrical and comprises an admission orifice 15, a pump body 16, and a delivery orifice 17, the pump body defining a pumping chamber 18 between walls 19 and 20 that are rigid, circularly symmetrical, and coaxial. The chamber 18 is of annular cross section with a radial thickness which decreases from the admission orifice 15 to the delivery orifice 17. A deformable tubular membrane 21 is housed in the tubular space 18 and is made of silicone elastomer, for example. This tubular or sleeve shaped membrane 21 defines in the pumping chamber 18 one or two circulation spaces 18*a* and 18*b* which can be either totally separated or in communication. An excitation motor member (not shown) generates a radial and regular distribution of periodic excitation forces 22, said distribution of forces being applied by means of a coupling to the edge 23 of the tubular membrane 21 adjacent to the admission orifice. The membrane is held under axial tension between the edges respectively near the admission and the delivery orifices by means (not shown) generating an axial regular distribution of tension forces 24 and 25 in opposite directions applied to the edges 23 and 26 of the membrane.

Figure 3:
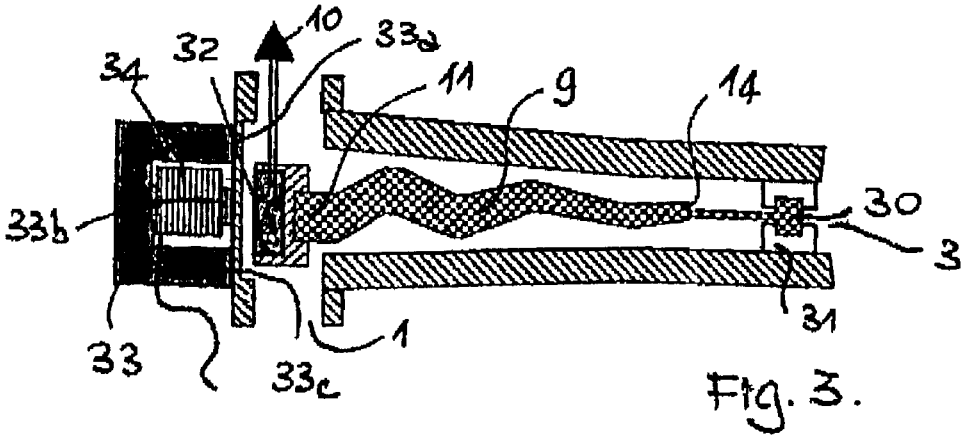
FIG. 3 is a diagrammatic longitudinal section view of FIG. 1 with one embodiment of motor means.

The membrane 9 shown FIG. 3 has an edge 11 near the admission orifice 1 thicker than the edge 14 near the delivery orifice 3. This edge 14 includes means 30 (a terminal rib for example) clamped into fixation means 31 of the pump body 2, having a transverse grove for the rib 30 and longitudinal slits for the fluid output.

A permanent magnet 32 is secured the thicker edge 11 of the membrane in front of a pole piece 33. The poles of the magnet are spaced from each other in a direction perpendicular to the membrane and the pole piece 33 has poles 33*a*, 33*b* and 33*c* which can change depending on the direction of the current in a coil 34. The pole piece and the coil constitute a variable magnetic field generator which moves the magnet 32 up and down generating waves in the membrane 9. The magnet or the securing structure thereof with the membrane may be guided in guide means not shown provided on the pump body 2. These guide means cooperate with fixation means 31 to put and maintain the membrane under longitudinal tension with a possible adjustment thereof.

Figure 4:
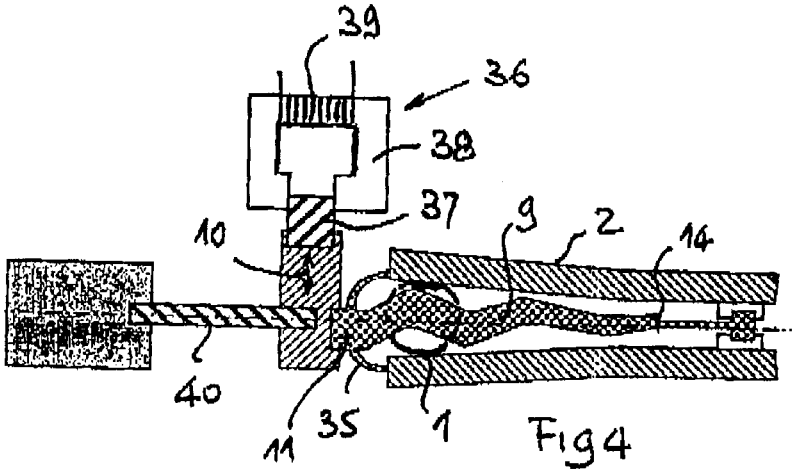
FIG. 4 is a section view of the invention like FIG. 3 with another embodiments of motor means and membrane.

FIG. 4 shows a variant embodiment of FIG. 3 in which the pump body 2 has a lateral admission orifice 1 and is closed near the thickest edge of the membrane 9 by flexible lips 35 tightly joined to the pump body 2. Membrane 9 is coupled beyond the lips to a magnetic motor 36 having a movable core 37 secured to the membrane 9 and a pole piece 38 with a coil 39 for periodically attracting the core into the air gap of the pole piece by a control current supplied to the coil. A blade spring 40 generates the necessary return force for having an oscillating vertical movement of the thickest edge of the membrane. Tension forces are created and maintained between the spring 40 and the fixation means 31.

Figure 5:
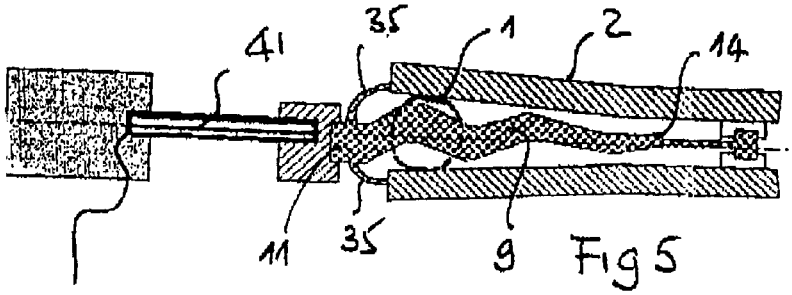
FIG. 5 is a section view of a variant of FIG. 4 with other motor means.

In FIG. 5 motor means are embodied as a piezoelectric displacement generator 41.

Figure 6:
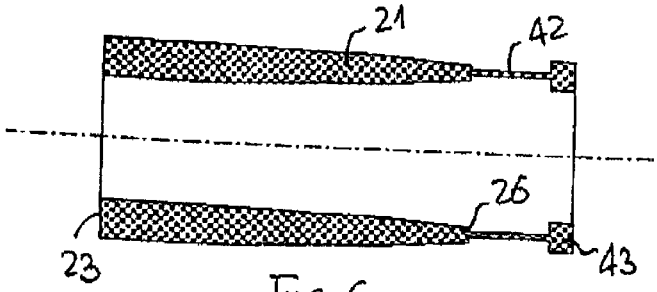
FIGS. 6 and 7 are two orthogonal section views of a sleeve shaped membrane.
Figure 7:
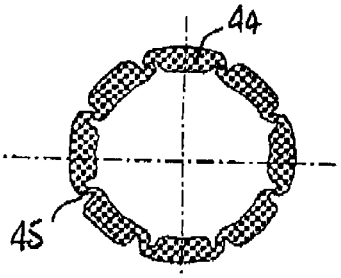

FIG. 6 and FIG. 7 show a tubular or sleeve shaped membrane 21 for the circulator of FIG. 2. This membrane has a thick edge 23 and a thin edge 26, the edge 26 being extended by a diaphragm sleeve 42 used to apply longitudinal tensile force to the sleeve. This diaphragm sleeve may be made of a material different from the membrane 21 and is provided with a terminal rib 43 for fixation into the pump body. The transversal section of FIG. 7 shows that the membrane 21 is made of a plurality of longitudinal lugs 44 laterally linked each other by a flexible diaphragm portion 45. In the illustrated case the diaphragm portion joints obliquely two adjacent lugs, extending from the internal face of one lug to the external face of the adjacent one. This structure allows an ability to a radial expansion and contraction of the tubular membrane under minimal radial forces.

Figure 8:
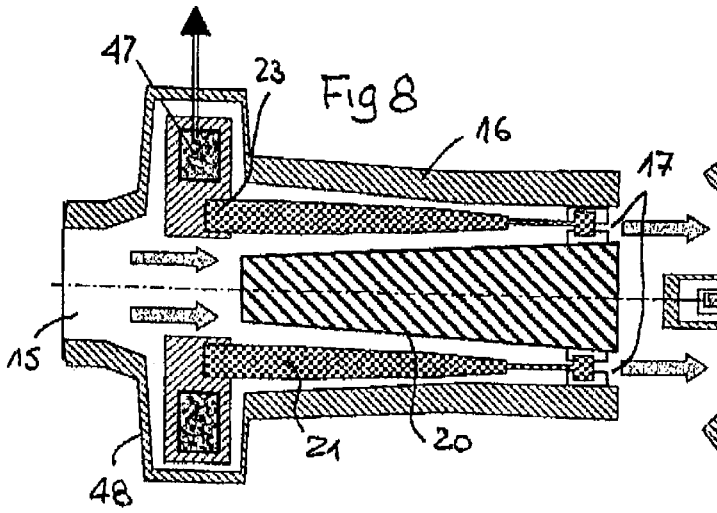
FIGS. 8 and 9 are orthogonal section views of an embodiment of the tubular pump as diagrammatically illustrated by FIG. 2.
Figure 9:
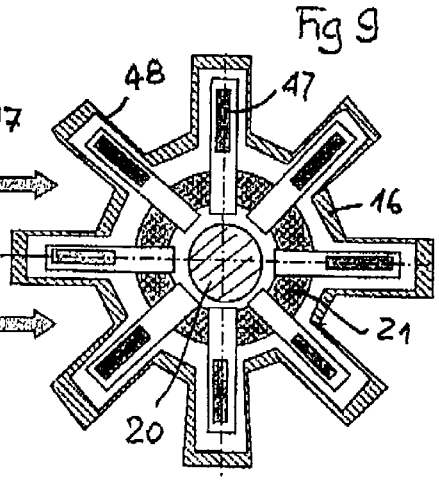
Figure 10:
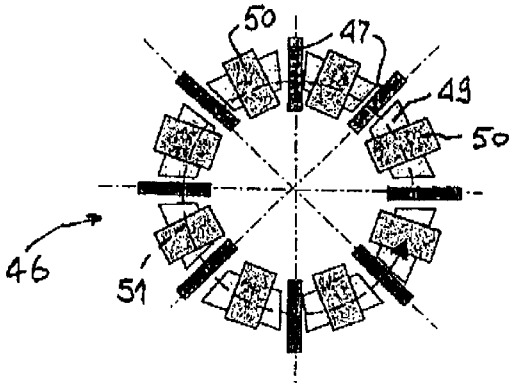
FIG. 10 is a functional sketch of the motor means of FIGS. 8 and 9.

FIGS. 8 to 10 show a circulator with a sleeve shaped membrane 21 located in a pump body 16 secured with its thin edge to this body in the same manner as the flat membrane is secured to the flat tubular body (FIG. 3) and coupled by its thick edge to a radial periodic forces generator 46. This generator includes permanent magnets 47 secured to the thick edge 23 of the membrane and extending along radial directions which are regularly distributed around the membrane. These magnets are maintained (or guided) in individual pockets 48 of the pump body. Between these pockets are located ferromagnetic cores 49 with coils 50 defining a plurality of electromagnets. The opposite poles of each magnet are radially spaced each from the other. For two consecutive permanent magnets, the north and south poles are inverted. In the rest state of the membrane, the average line 51 of the poles of the electromagnet is located between the poles of the permanent magnets 47. By supplying the coils 50 with an alternative current, the sign of the poles on the line 51 changes periodically and generates successive attraction of each pole of the permanent magnets along their radial alignment, thus generating periodic expansions and contractions of the membrane 21.

In each embodiment of the invention, the membrane excitation means are constituted by an electromagnetic motor whose feed circuit for receiving excitation alternating current includes a power amplifier circuit and a circuit for generating an excitation signal so as to provide the possibilities of modulating amplitude, of programming, of storage, and of generating complex excitation signals, enabling the circulator of the invention to comply with numerous applications.

What is claimed is:

1. A membrane fluid circulator comprising an internal hydraulic circuit made up in succession of an admission orifice, a pump body and a delivery orifice, the pump body having two rigid walls defining there between a pumping chamber for the fluid extending from said admission orifice to said delivery orifice with a deformable membrane located in said pumping chamber and having two external surfaces facing respectively said walls, at least one of said membrane surfaces and at least one of said walls defining in said pumping chamber a circulation space for the fluid, said deformable membrane being maintained under a tension parallel to the fluid circulation direction from said admission orifice to said delivery orifice, said membrane having one edge located near said admission orifice and provided with means for coupling to motor means for generating a periodic excitation force substantially normal to the external faces of said membrane, said circulation space having a cross section perpendicular to the circulation fluid direction which has a size measured along the periodic force direction progressively decreasing from said admission orifice to said delivery orifice.

2. A circulator according to claim 1, wherein said pumping chamber is a flat tubular chamber and the membrane is a flat membrane tapered towards the edge thereof located near said delivery orifice.

3. A circulator according to claim 1, wherein said pumping chamber is an annular tubular chamber and the membrane is shaped as a sleeve with a larger thickness at its edge near said admission orifice than at its edge near said delivery orifice.

4. A circulator according to claim 3, wherein said sleeve shaped membrane is made of a plurality of elongated lugs thicker near said admission orifice than near said delivery orifice regularly distributed into the pump chamber and laterally connected each to the other by thin flexible diaphragms.

5. A circulator according to claim 1, wherein said motor means include a magnetic field generator secured to the pump body fed by a periodic excitation current of intensity which is modulated to modulate the excitation force and thus the hydraulic power delivered by the circulator, and a movable ferromagnetic element secured to the edge of the membrane located near the admission orifice.

6. A circulator according to claim 1, wherein said motor means include a piezoelectric vibrator extending between said pump body and said edge of the membrane near the admission orifice.

* * * * *